US009752771B2

(12) United States Patent
Loos

(10) Patent No.: US 9,752,771 B2
(45) Date of Patent: Sep. 5, 2017

(54) FRAME FOR AN ORNAMENTAL DECORATION

(71) Applicant: Frederick Loos, St. Clair Shores, MI (US)

(72) Inventor: Frederick Loos, St. Clair Shores, MI (US)

( * ) Notice: Subject to any disclaimer, the term of this patent is extended or adjusted under 35 U.S.C. 154(b) by 167 days.

(21) Appl. No.: 14/705,428

(22) Filed: May 6, 2015

(65) Prior Publication Data

US 2016/0150903 A1 Jun. 2, 2016

Related U.S. Application Data

(60) Provisional application No. 61/994,489, filed on May 16, 2014.

(51) Int. Cl.

| | |
|---|---|
| ***F21V 33/00*** | (2006.01) |
| ***A47G 33/06*** | (2006.01) |
| *F21W 121/04* | (2006.01) |

(52) U.S. Cl.

CPC ..... *F21V 33/0028* (2013.01); *A47G 33/06* (2013.01); *F21W 2121/04* (2013.01)

(58) Field of Classification Search

CPC . F21V 33/0028; A47G 33/06; F21W 2121/04
USPC ..... 362/249.18–249.19
See application file for complete search history.

(56) References Cited

U.S. PATENT DOCUMENTS

| | | | | |
|---|---|---|---|---|
| 3,704,366 A | | 11/1972 | Korb et al. | 240/10 T |
| 3,808,082 A | * | 4/1974 | Steiber | A47G 33/06 428/12 |
| 3,967,019 A | | 6/1976 | Magee | 428/7 |
| 4,620,270 A | | 10/1986 | Laakso | 362/123 |
| 4,962,907 A | | 10/1990 | Gary | 248/205.3 |
| 5,359,502 A | * | 10/1994 | Cantin | A47G 33/06 362/123 |
| 5,488,549 A | * | 1/1996 | Miller | A01G 5/04 211/195 |
| 5,758,948 A | * | 6/1998 | Hale | A47G 33/06 362/123 |
| 6,264,155 B1 | | 7/2001 | Ardrey | 248/346.01 |
| 6,328,459 B1 | | 12/2001 | Adams | 362/396 |
| 6,334,694 B1 | | 1/2002 | Huang | 362/123 |

(Continued)

OTHER PUBLICATIONS

"Multi Section Tree Frames", Christmas-LEDs.com, http://www.christmas-leds.com/productinfo_v3.aspx?productid=4S . . . , 1 page; Apr. 15, 2014.

(Continued)

*Primary Examiner* — Julie Bannan
(74) *Attorney, Agent, or Firm* — Christopher P. Maiorana, PC

(57) ABSTRACT

An apparatus comprising a plurality of legs. Each of the legs may have a plurality of holders and a base. The base may comprise (i) a first connector on one side of the base and (ii) a second connector on another side of the base. Each of the plurality of legs may be configured to (i) connect to the second connector of one of the plurality of legs using the first connector, (ii) connect to the first connector of another of the plurality of legs using the second connector, (iii) be flexible about an axis and (iv) be arranged in a circular fashion. The holders may be configured to secure one or more lights of a strand of lights.

20 Claims, 16 Drawing Sheets

(56) References Cited

U.S. PATENT DOCUMENTS

| | | | | |
|---|---|---|---|---|
| D476,594 | S * | 7/2003 | Preuss | D11/118 |
| 7,021,927 | B1 * | 4/2006 | Gryzlak | F21S 13/14<br>248/166 |
| 2008/0151569 | A1 * | 6/2008 | Wang | A47G 33/06<br>362/249.16 |

OTHER PUBLICATIONS

"Here's How You Can Make a Miniature Lit Christmas Tree Out of Recycled Wire Coat Hangers", http://askville.amazon.com/Create-Christmas-Tree-Coat-Hangers-Explain/AnswerViewer.do?r . . . , pp .1-2; Apr. 18, 2014.

"Tinsel Christmas Trees", http://savvymumma.com/2009/11/tinsel-christmas-trees.htm, pp. 1-4; Nov. 18, 2009.

"Coat Hanger Christmas Trees", http://www.mindspring.com/~putertek/coat_hanger_christmas_trees.htm, pp. 1-2; Apr. 15, 2014.

* cited by examiner

FRAME FOR AN ORNAMENTAL DECORATION

This application relates to U.S. Provisional Application No. 61/994,489, filed May 16, 2014, which is hereby incorporated by reference in its entirety.

FIELD OF THE INVENTION

The present invention relates to frames generally and, more particularly, to a method and/or apparatus for implementing a frame for an ornamental decoration.

BACKGROUND OF THE INVENTION

Ornamental decorations are desirable, especially around the holiday season. Such decorations are intended to lighten up the mood and create a holiday spirit. While many families assemble a full size Christmas tree, smaller tabletop Christmas trees are often desirable, particularly in a limited space environment. One conventional approach for implementing such a tabletop Christmas tree is to use old coat hangers. The coat hangers are bent into a frame that is used to support decorative material. However, such conventional coat hanger frames are often frustrating to assemble, provide inconsistent results, and/or are otherwise time consuming to assemble.

It would be desirable to implement a frame for an ornamental decoration.

SUMMARY OF THE INVENTION

The present invention concerns an apparatus comprising a plurality of legs. Each of the legs may have a plurality of holders and a base. The base may comprise (i) a first connector on one side of the base and (ii) a second connector on another side of the base. Each of the plurality of legs may be configured to (i) connect to the second connector of one of the plurality of legs using the first connector, (ii) connect to the first connector of another of the plurality of legs using the second connector, (iii) be flexible about an axis and (iv) be arranged in a circular fashion. The holders may be configured to secure one or more lights of a strand of lights.

The objects, features and advantages of the present invention include providing a frame for an ornamental decoration that may (i) be implemented using a molding process, (ii) snap together, (iii) secure strands of lights and/or (iv) be easy to assemble.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Embodiments of the invention include implementing a frame for an ornamental decoration. The frame may hold (or support) garland, or other ornamental materials. The frame may be made using a molding process to form individual pieces (or legs) that may be snapped together quickly and easily. The ornamental design may be a Christmas tree, a flower arrangement, or other decorative type arrangement. In one example, the tree may be around 18 inches high, suitable to be used as a desktop (or tabletop) decoration and/or a decoration stored in a shelving unit or wall unit. The tree may hold strings of lights, such as LED lights, or conventional incandescent lights. Portions of the frames may be snapped together to provide easy assembly.

Figure 1:
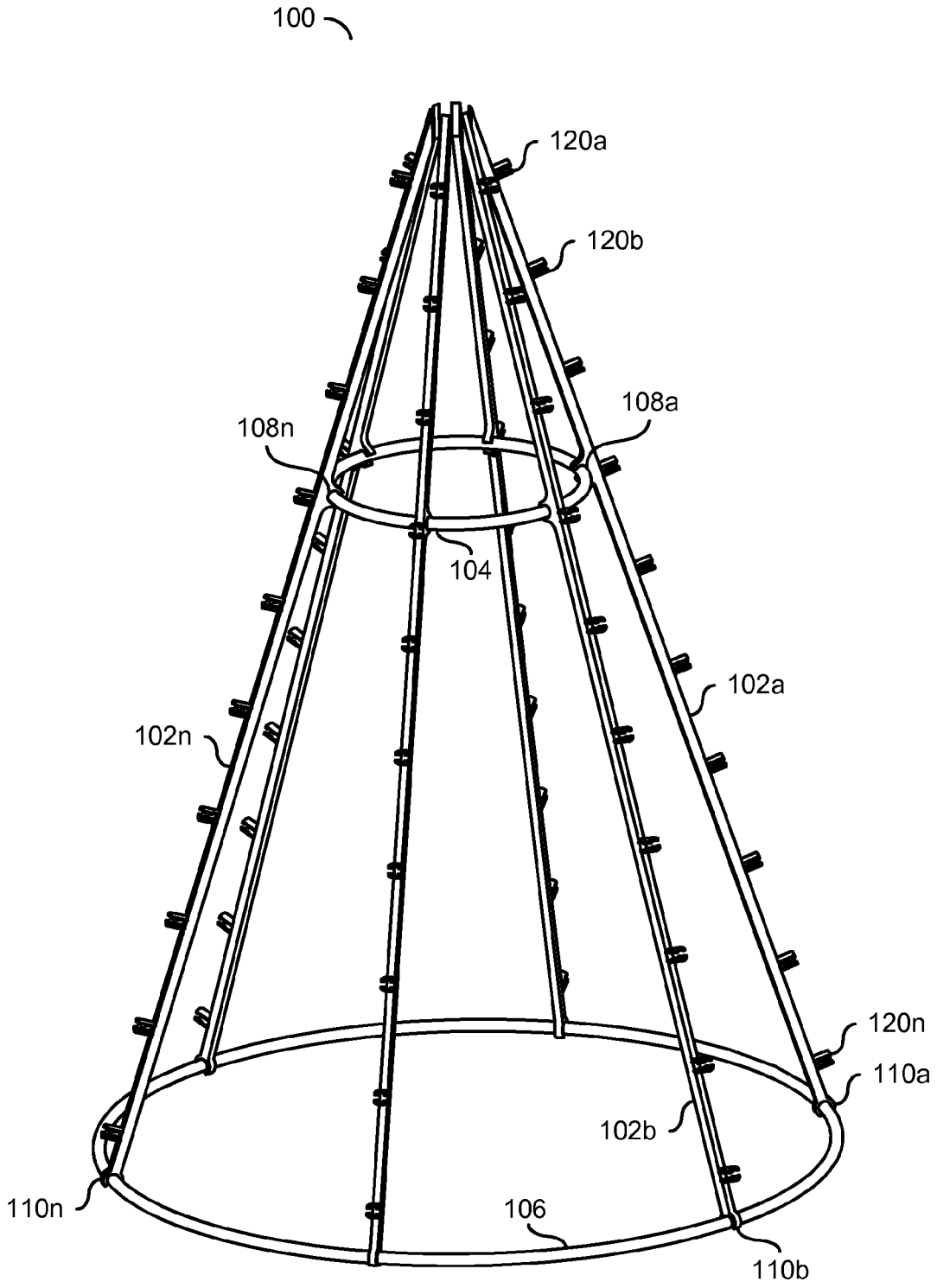
FIG. 1 is an overall view of a frame in accordance with an embodiment of the invention.

Referring to FIG. 1, an overall diagram of an apparatus 100 is shown in accordance with an embodiment of the invention. The apparatus 100 may be a Christmas tree, or other decorative arrangement. The apparatus 100 generally comprises a plurality of legs 102*a*-102*n*, a support portion (or connection portion) 104 and a support portion (or connection portion) 106. Each of the legs may have a first attachment portion 108 and a second attachment portion 110. In one example, the leg 102*a* may have a first attachment portion 108*a* and a second attachment portion 110*a*. The first attachment portion may be configured to clip onto the support portion 104. The second attachment portion 110*a* may be configured to clip onto the support portion 106. Alternate forms of the connection may be shown in the various figures. A number of holders 120*a*-120*n* are shown on the leg 102*a*. The holders may be configured to hold a strand of lights and/or other decorations (e.g., garland, ornaments, etc.). For example, the holder 120*a* may hold a first bulb of a strand of lights. The holder 120*b* may be configured to hold a second bulb of a plurality of lights.

Figure 2:
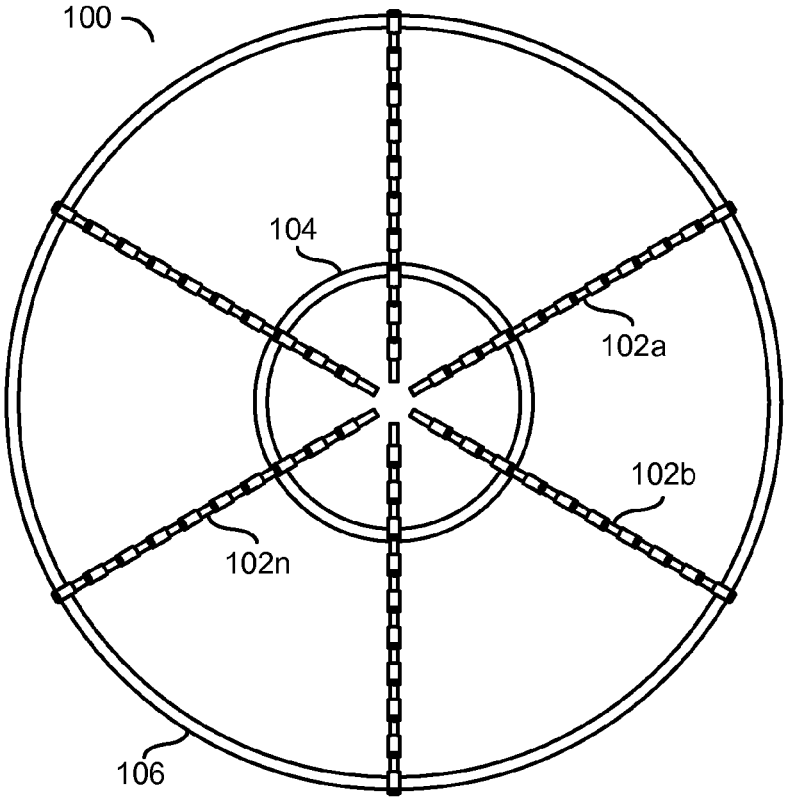
FIG. 2 is a top view of the frame of FIG. 1.

Referring to FIG. 2, a top view of the apparatus 100 is shown. The support portion 104 is shown as an inner circle that is connected to each of the legs 102*a*-102*n* (e.g., attached to the attachment portions 108*a*-108*n*). The support portion 106 is shown as an outer circle that is also connected to each of the legs 102*a*-102*n* (e.g., attached to the attachment portions 110*a*-110*n*). More support portions may be implemented based on a size of the apparatus 100 (e.g., to provide greater stability and/or structural integrity). For example, more support portions may prevent the legs 102*a*-102*n* from sliding side-to-side. Generally, additional support portions may be implemented as circular portions having sizes (e.g., a radius) in between the size of the inner support portion 104 and the outer support portion 106. For example, the inner support portion 104, the outer support portion 106 and/or any additional support portions may be arranged in a concentric fashion. The support portion 104 and/or 106 may be multi-sided. The legs 102*a*-102*n* may accommodate additional support portions by implementing a corresponding amount of additional attachment portions. The number of support portions and/or attachment portions may be varied according to the design criteria of a particular implementation.

Figure 3:
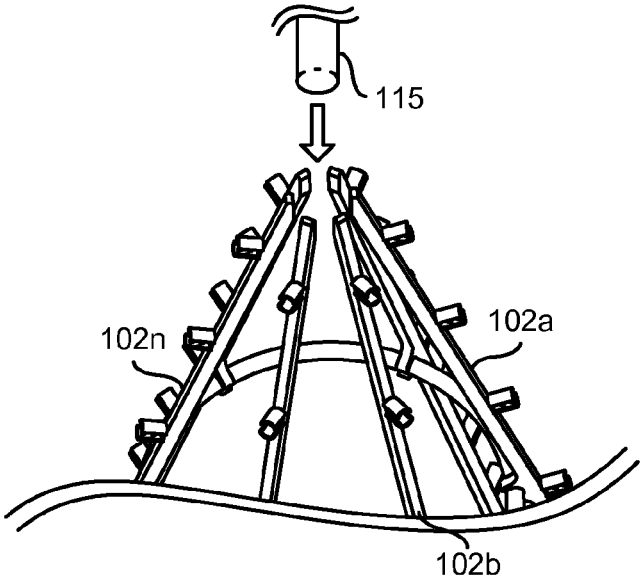
FIG. 3 shows details of a top portion of the frame.
Figure 4A:
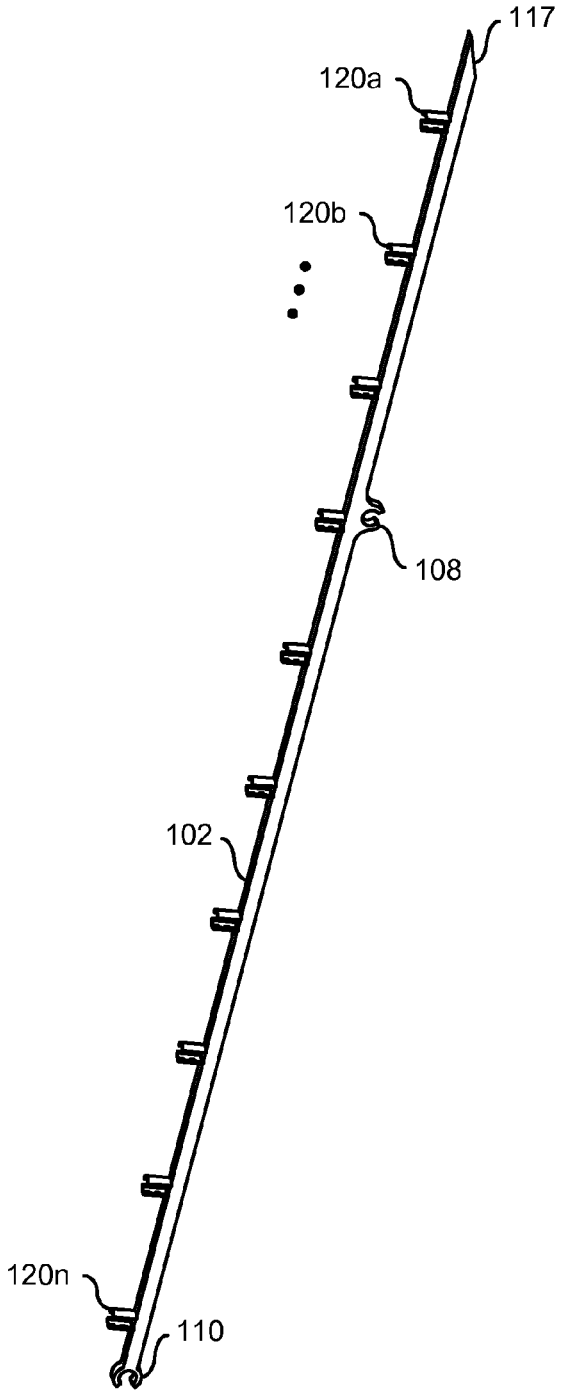
FIGS. 4(*a*)-4(*d*) show details of one of the legs of a frame.
Figure 4B:
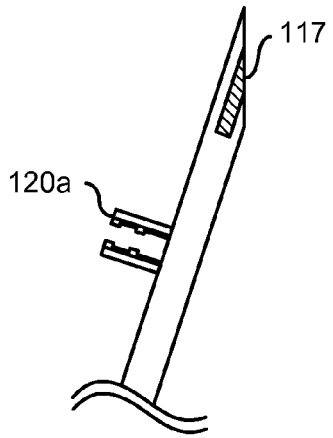
Figure 4C:
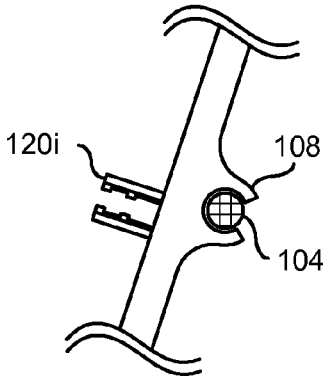
Figure 4D:
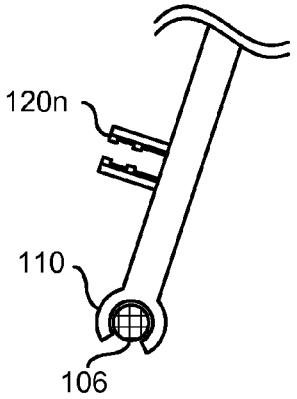

Referring to FIG. 3, a view of a top portion of the apparatus 100 is shown. The top portion may be configured to hold or mount an ornament 115. The ornament 115 may be implemented as a star or an angel. The legs 102*a*-102*n* may lean inward towards the top of the apparatus 100. For example, the legs 102*a*-102*n* may meet (e.g., touch and/or connect) at the top of the apparatus 100. When the legs 102*a*-102*n* meet at the top of the apparatus 100, space may not be available for the ornament 115. In another example, the legs 102*a*-102*n* may approach (but not touch) at the top of the apparatus 100, leaving a space. The space may be available to insert the ornament 115. In some embodiments, the tops of the legs 102*a*-102*n* may provide support (e.g., a small platform) to hold the ornament 115.

Referring to FIGS. 4(*a*)-4(*d*), a diagram of one of the legs is shown. The legs 102*a*-102*n* may be angled on the inside to fit the top portion of the legs 102*a*-102*n* at the top of the apparatus 100. A narrow and/or angled inside portion 117 of the leg 102 may implement a hole to provide support for mounting an angel or a star (e.g., the ornament 115). Details of the inside portion 117 are shown in FIG. 4(*b*). The open sides of the holders 120*a*-120*n* are shown configured to hold a wire, or a mini LED (to be described in more detail in connection with FIG. 5). In one example, the string of lights may be 50 to 100 lights. The lights may be held out and away from the legs 102*a*-102*n* and/or the support portions 104 and/or 106. In one example, the apparatus may hold 45-60 feet of colored garlands, decorative materials, etc.

The middle of the leg 102 (e.g., the attachment portion 108) may be molded to clip and/or insert into the support portion 104. In some embodiments, the connection 108 may be a slip fit (e.g., as shown in FIG. 4(*c*)). In some embodiments, the connection 108 may be inserted into the support portion 104. The bottom of the leg 102 (e.g., the attachment portion 110) may be molded to clip and/or insert into the support portion 106. In some embodiments, the connection 110 may be a slip fit (e.g., as shown in FIG. 4(*d*)). In some embodiments, the connection 110 may be inserted into the support portion 106.

Figure 5:
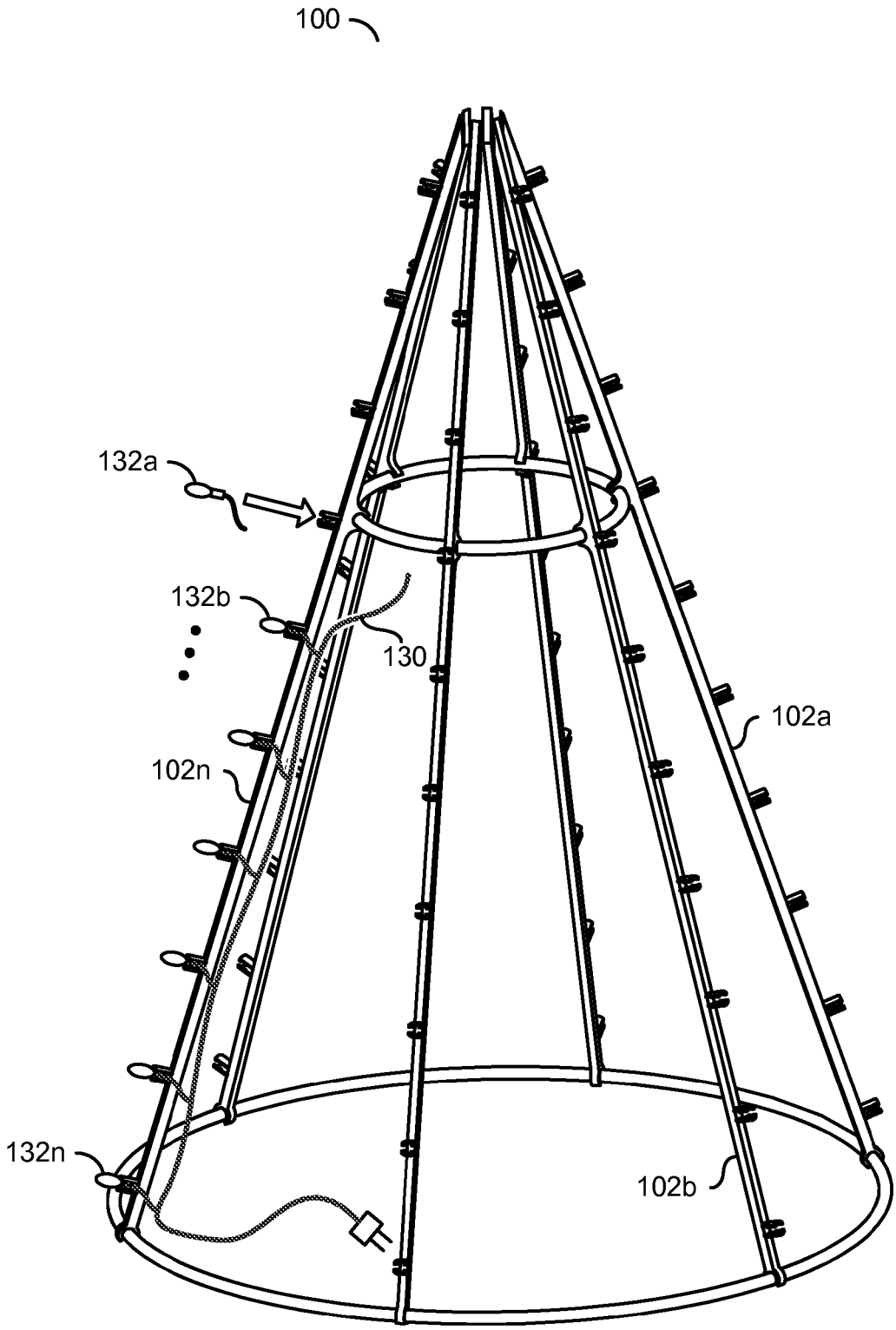
FIG. 5 shows details of how a light string is attached to one of the legs.

Referring to FIG. 5, a diagram illustrating the attachment of a string of lights 130 is shown. A number of lights 132*a*-132*n* are shown connected to the string of lights 130. Each of the lights 132*a*-132*n* may be implemented as a small incandescent bulb, an LED bulb, or other type of light. The lights 132*a*-132*n* may be removably inserted into the holders 120*a*-120*n*. In some embodiments, the holders 120*a*-120*n* may be implemented to fit only a particular type of ends of the lights 132*a*-132*n* (e.g., the lights 132*a*-132*n* and the apparatus 100 may be sold as a single product). In some embodiments, the holders 120*a*-120*n* may be implemented to fit a variety of ends of the lights 132*a*-132*n* (e.g., the holders 120*a*-120*n* may be universal). An order of insertion and/or an arrangement of the lights 132*a*-132*n* may be varied according to the design criteria of a particular implementation. Generally, any order of insertion and/or arrangement of the lights 132*a*-132*n* may be selected. In some embodiments, the holders 120*a*-120*n* may have indicators (e.g., be color-coded) to allow for particular designs and/or arrangements of the lights 132*a*-132*n*.

Figure 6:
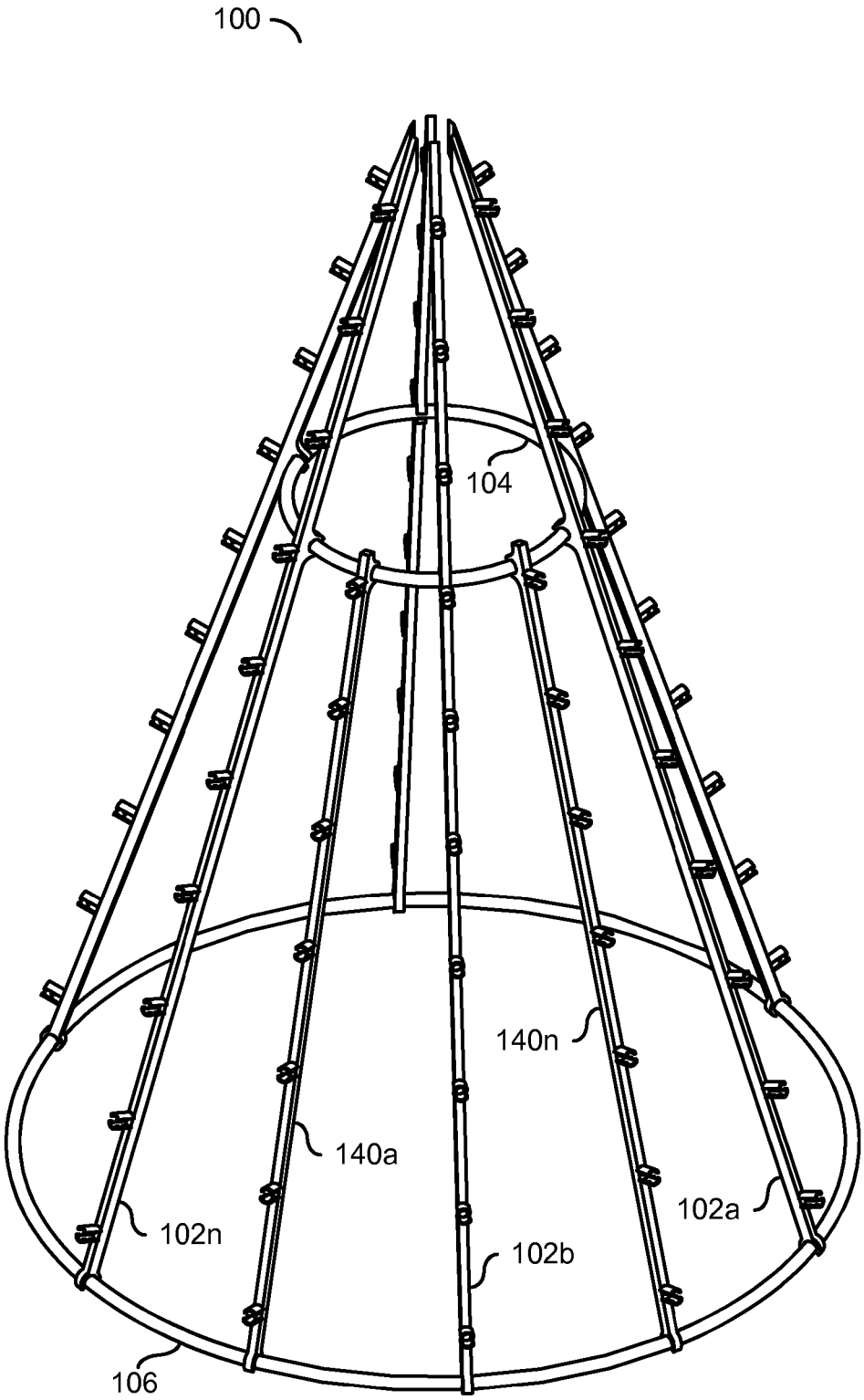
FIG. 6 shows an alternate diagram with one or more partial legs.

Referring to FIG. 6, a diagram illustrating a number of partial legs 140*a*-140*n* is shown. The partial legs 140*a*-140*n* are shown connected in an alternating pattern with the legs 102*a*-102*n*. The legs 102*a*-102*n* are shown implemented longer than the partial legs 140*a*-140*n*. The partial legs 140*a*-140*n* generally connect between the securing portion 104 and the securing portion 106. The partial legs 140*a*-140*n* may be shorter than the legs 102*a*-102*n*. Since the point (e.g., the top) of the cone formed by the apparatus 100 is denser than the bottom of the cone, fewer of the partial legs 140*a*-140*n* may be needed. Implementing the partial legs 140*a*-140*n* may reduce a cost of manufacturing the apparatus 100. Implementing the partial legs 140*a*-140*n* may allow for larger ornaments at the top of the apparatus 100 (e.g., by reducing crowding of the ornaments).

Figure 7:
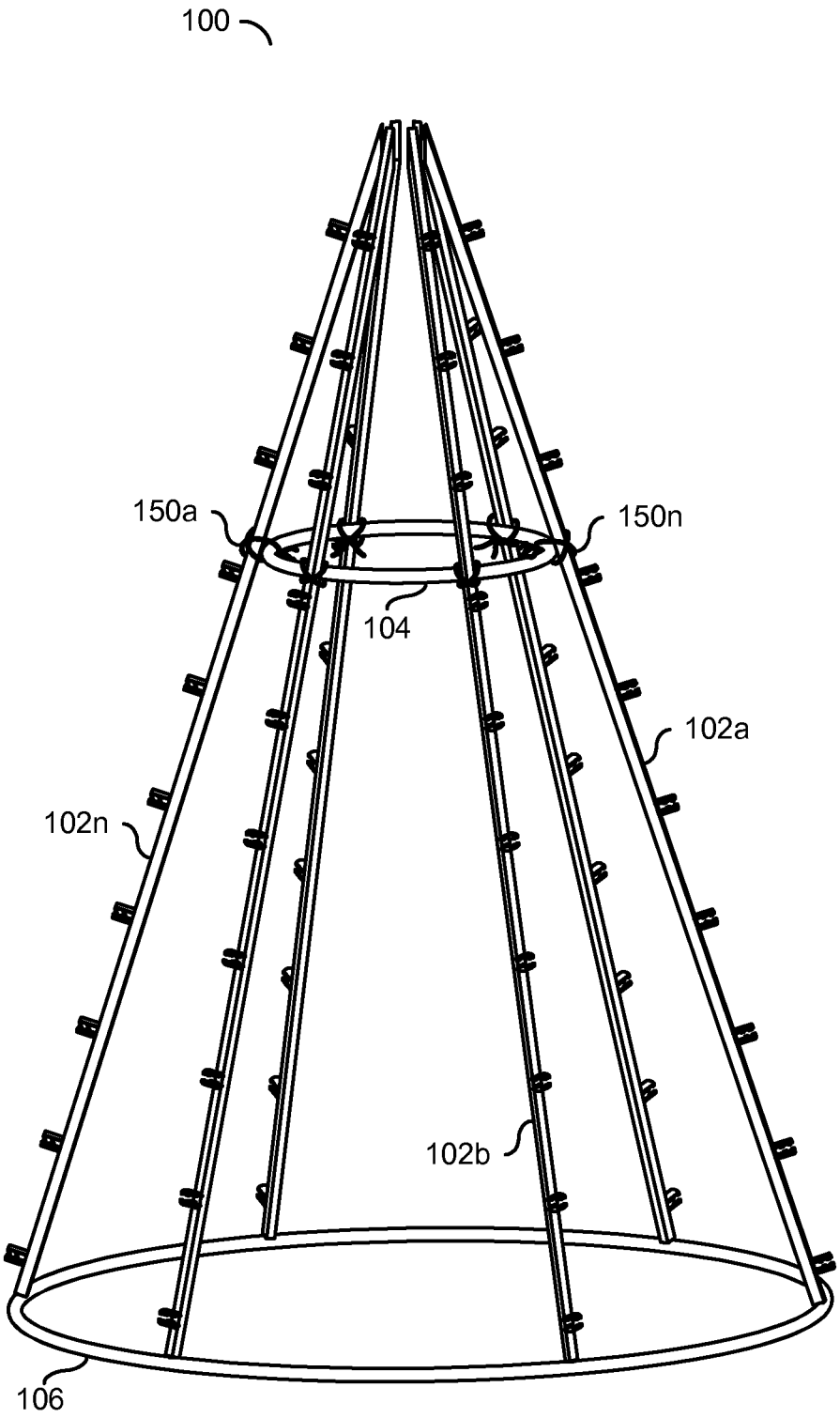
FIG. 7 shows an alternate diagram for connecting a top portion of the legs.

Referring to FIG. 7, a diagram of an alternate top attachment portion for the apparatus 100 is shown. A number of ties 150*a*-150*n* are shown. The ties 150*a*-150*n* are shown connecting the legs 102*a*-102*n* to the securing portion 104. In some embodiments, the ties 150*a*-150*n* may be implemented instead of the attachment portions 108*a*-108*n*. In some embodiments, the ties 150*a*-150*n* may be implemented in addition to the attachment portions 108*a*-108*n*. In one example, the ties 150*a*-150*n* may be implemented as twist ties. In another example, the ties 150*a*-150*n* may be implemented as bendable wires. The ties 150*a*-150*n* may be colored. For example, the ties 150*a*-150*n* may be colored to conceal the twist ties 150*a*-150*n* when viewing the apparatus 100. In another example, the ties 150*a*-150*n* may be colored (e.g., with festive colors) to provide an additional decorative effect. The implementation of the twist ties 150*a*-150*n* may be varied according to the design criteria of a particular implementation.

Figure 8:
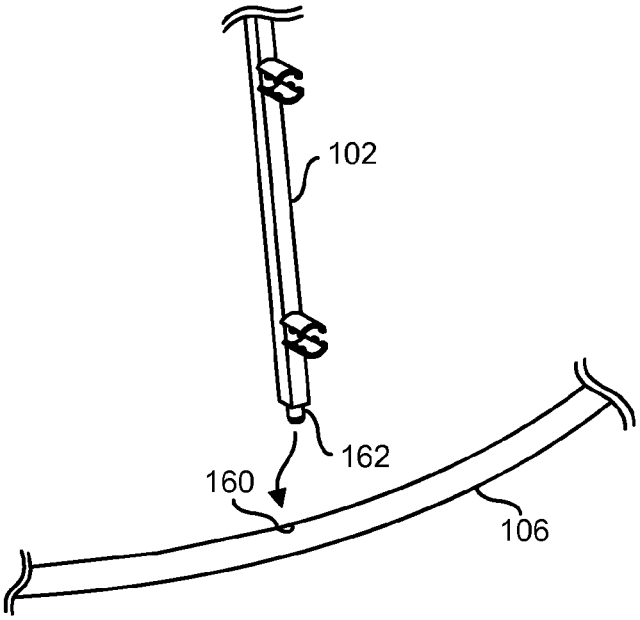
FIG. 8 shows an alternate diagram for securing the bottom portion of the legs.

Referring to FIG. 8, a diagram of an alternate bottom securing portion 106 is shown. The securing portion 106 is shown having a hole 160. The hole 160 may accept a protrusion 162 that may be implemented on the bottom of the leg 102. The hole 160 is shown configured to slide on the protrusion 162 of the leg 102. In some embodiments, the protrusion 162 may be threaded to allow the leg 102 to be screwed into the hole 160 of the securing portion 106. In some embodiments, the protrusion 162 may be configured to snap into the hole 160. The implementation and/or shape of the hole 160 and/or the protrusion 162 may be varied according to the design criteria of a particular implementation.

Figure 9:
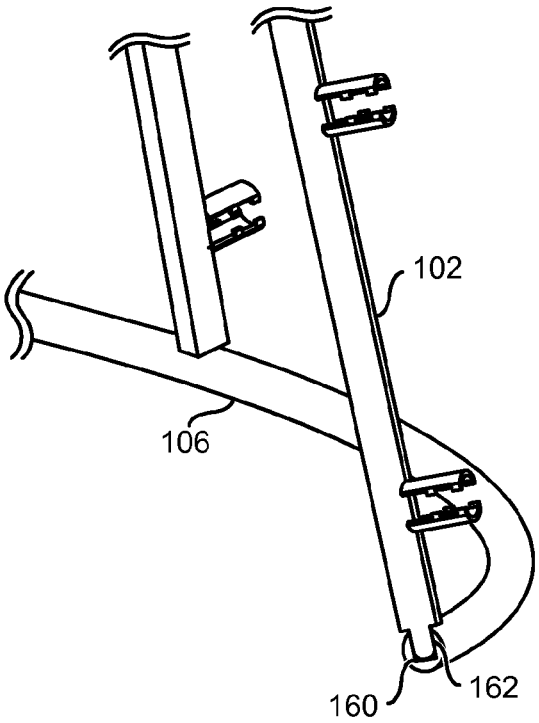
FIG. 9 shows a cross section of the alternate connection of the bottom portion of the leg shown in FIG. 8.

Referring to FIG. 9, a diagram of a side view of the securing portion 106 of FIG. 8 is shown. A cross-section of the securing portion 106 is shown. The hole 160 is shown having a generally square outline. The protrusion 162 is shown having a slightly rounded outline. However, the particular shape of the outline of the hole 160 and/or the protrusion 162 may be varied depending on the design criteria of a particular implementation. Screwing and/or snapping the protrusion 162 into the hole 160 may improve the structural integrity of the apparatus 100.

Figure 10A:
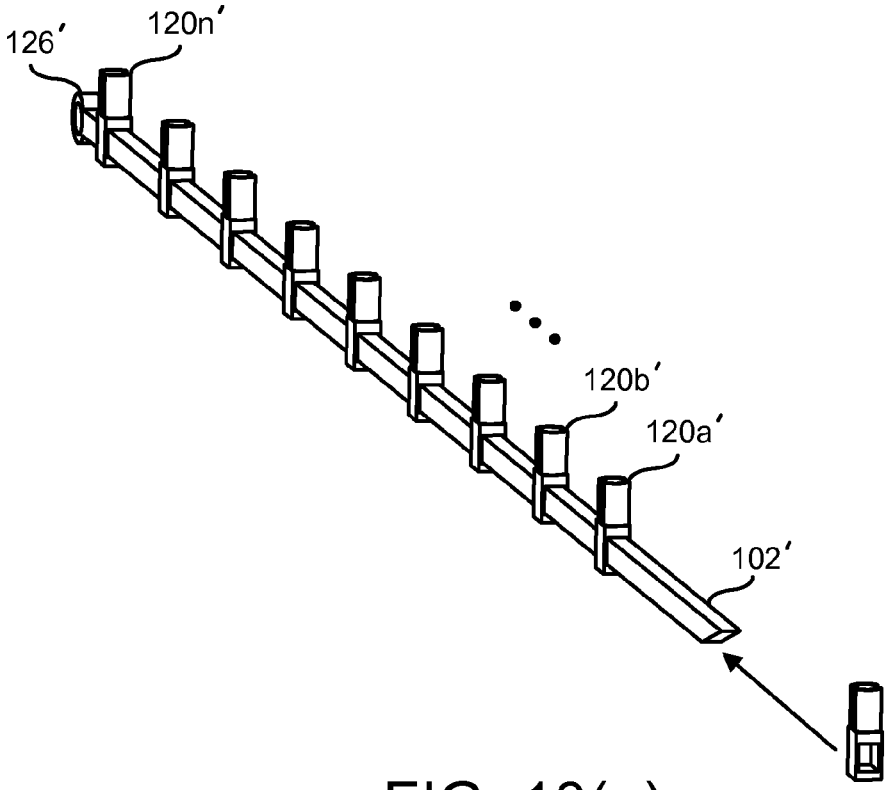
FIGS. 10(*a*)-10(*b*) show details of a slidable bulb holder.
Figure 10B:
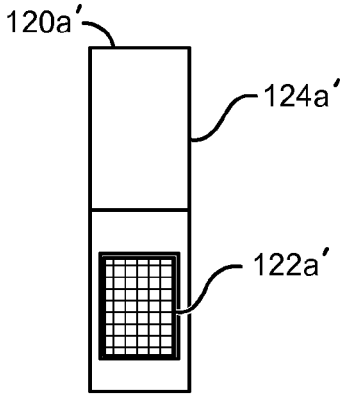

Referring to FIG. 10(*a*) and FIG. 10(*b*), a diagram of an alternate leg 102' with a slidable bulb attachment portion 120' is shown. Referring to FIG. 10(*a*), the alternate leg 102' is shown having a number of slidable bulb attachment portions 120*a*'-120*n*'. The slidable bulb attachment portions 120*a*'-120*n*' may be free to slide about the alternate leg 102'. FIG. 10(*b*) shows a cross-section of one of the slidable bulb attachment portions 120*a'*.

The slidable bulb attachment portions 120*a*'-120*n*' may be configured to have an opening 122*a*' and a holder portion 124*a*'. FIG. 10(*b*) shows the slidable portion 120*a*' having the opening 122*a*' and the holder portion 124*a*'. The holder portion 124*a*' may hold one of the lights 132*a*-132*n*. The opening 122*a*' may be configured to slide over the alternate leg 102'. For example, the opening 122*a*' may slide up and down the length of the alternate leg 102'. The alternate leg 102*a*' may be implemented with a stopper 126'. The stopper 126' may prevent the slidable bulb attachment portions 120*a*'-120*n*' from sliding off the alternate leg 102'. The stopper 126' may be implemented on each end of the alternate leg 102'.

Figure 11A:
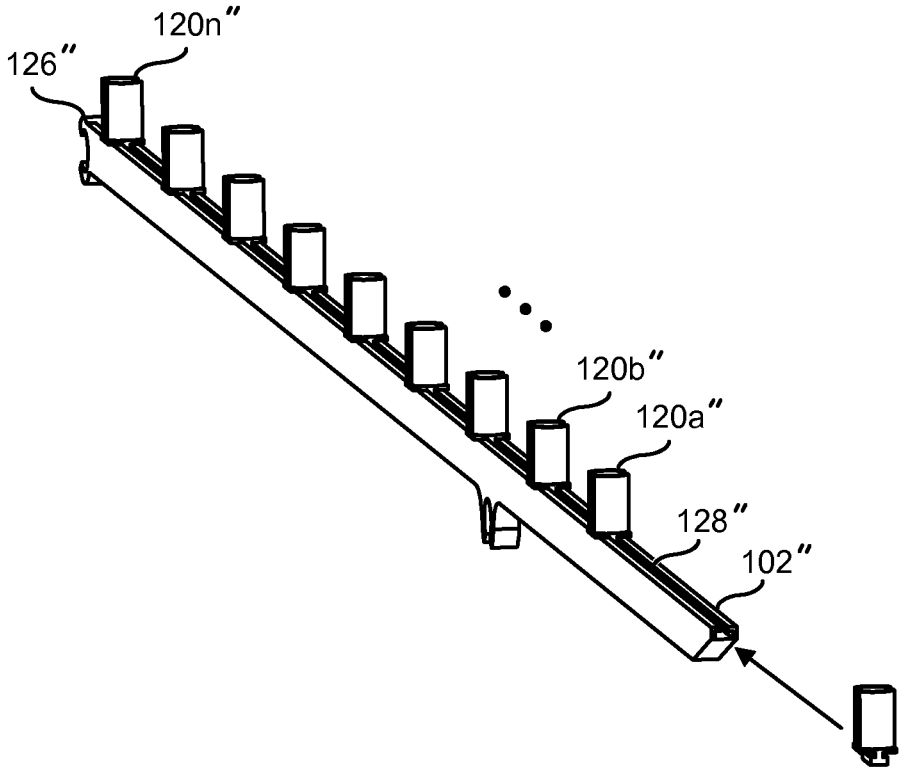
FIGS. 11(*a*)-11(*b*) show additional details of a slidable bulb holder.
Figure 11B:
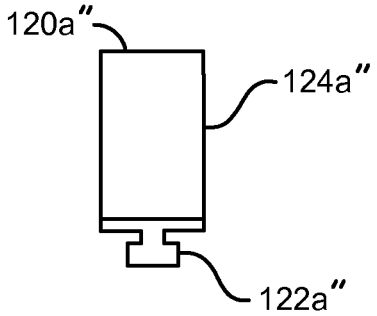

Referring to FIG. 11(*a*) and FIG. 11(*b*), a diagram of an alternate slidable bulb attachment portion 120*a*" is shown. Referring to FIG. 11(*a*), an alternate leg 102" is shown having a number of slidable bulb attachment portions 120*a*"-120*n*". The slidable bulb attachment portions 120*a*"-120*n*" may be configured to slide along a track 128" in the alternate leg 102". The alternate leg 102" may implement a stopper 126". The stopper 126" may be configured to prevent the slidable bulb attachment portions 120*a*"-120*n*" from sliding out of the track 128". The stopper 126" may be removable to allow the slidable bulb attachment portions 120*a*"-120*n*" to be replaced.

Referring to FIG. 11(*b*), a cross section of one of the slidable bulb attachment portions 120*a*" is shown. The slidable bulb attachment portion 120*a*" is shown having a notch 122*a*" and a holder 124*a*". The notch 122*a*" may be configured to secure the slidable bulb attachment portion 120*a*" in the track 128", while allowing the slidable bulb attachment portion 120*a*" to slide along the track 128". Generally, the shape of the notch 122*a*" may correspond the shape of the track 128". The shape of the notch 122*a*" and/or the track 128" may be varied according to the design criteria of a particular implementation. The holder 124*a*" may be configured to hold one of the lights 132*a*-132*n*.

Figure 12:
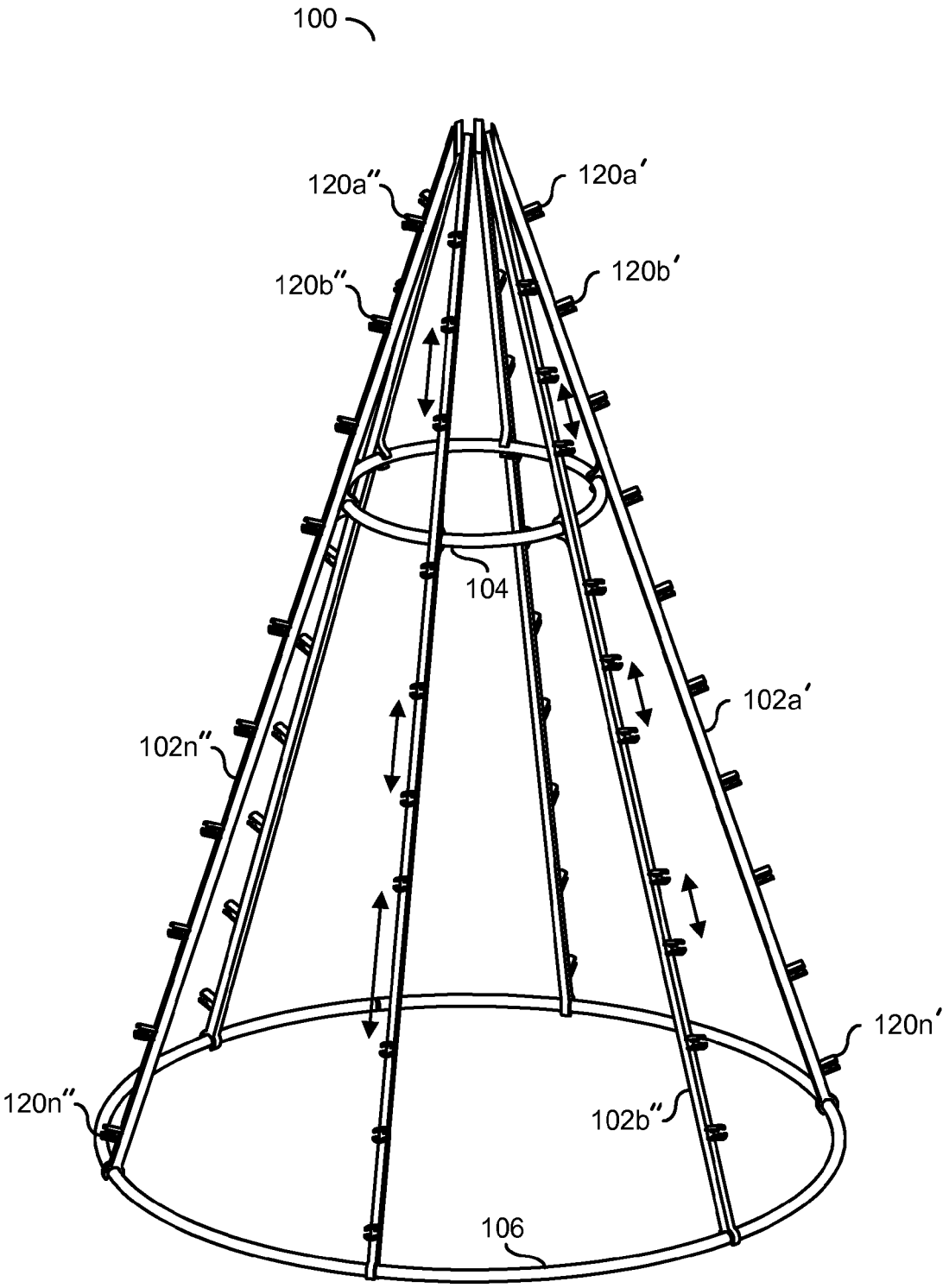
FIG. 12 shows a diagram of the overall frame with the slidable bulb holders.

Referring to FIG. 12, a diagram of the apparatus 100 showing the slidable bulbs is shown. The apparatus 100 shown in FIG. 12 may implement either slidable bulb attachment portions 120*a*'-120*n*' and/or the slidable bulb attachment portions 120*a*"-120*n*". The particular position of each of the slidable bulb attachment portions 120W-120*n*' (or 120*a*"-120*n*") may move up and down each of the alternate legs 102*a*'-102*n*' (or 102*a*"-102*n*"). The spacing between the slidable bulb attachment portions 120*a*'-120*n*' (or 120*a*"-120*n*") may be varied to allow for a variety of decorative designs.

Figure 13:
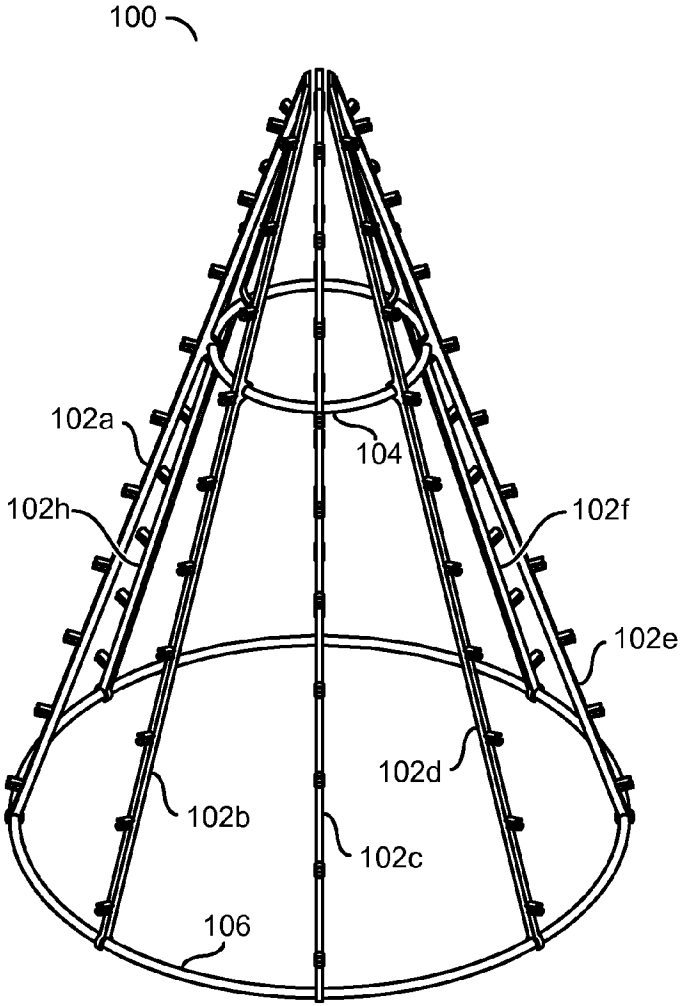
FIG. 13 shows an embodiment with eight legs.

Referring to FIG. 13, an overall diagram of an embodiment of the apparatus 100 with eight legs is shown. The apparatus 100 is shown in a generally perspective view. The eight legs 102*a*-102*h* are shown spaced evenly around the apparatus 100.

Figure 14:
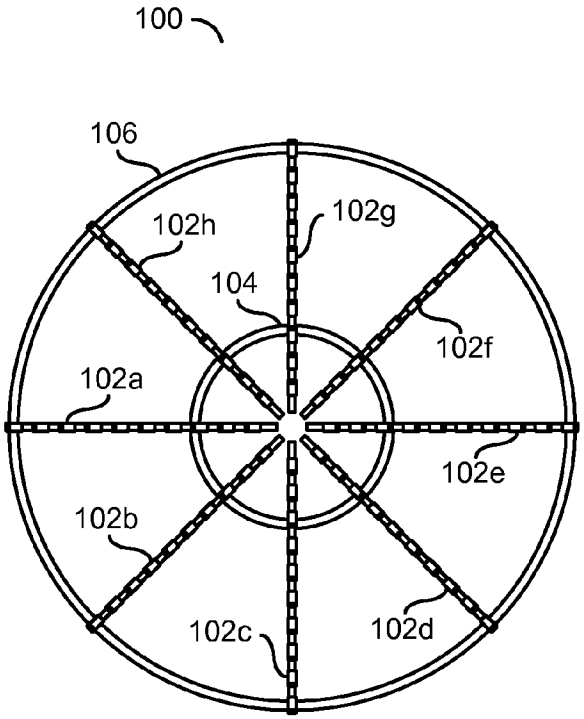
FIG. 14 shows a top view of the embodiment of FIG. 13.

Referring to FIG. 14, a top view of the embodiment of FIG. 13 is shown. The apparatus 100 is shown from a generally overhead view. The example of the apparatus 100 shown in FIG. 14 shows an implementation with the eight legs 102*a*-102*h*. The top view shows the eight legs 102*a*-102*h* evenly spaced about the support portion 104 and the support portion 106. Each of the legs 102*a*-102*h* are shown leaning inward from the support portion 106. Each of the legs 102*a*-102*h* generally approach (e.g., come close to) but do not touch the other legs 102*a*-102*h*. In some embodiments, the legs 102*a*-102*h* may touch at the top of the apparatus 100.

Figure 15:
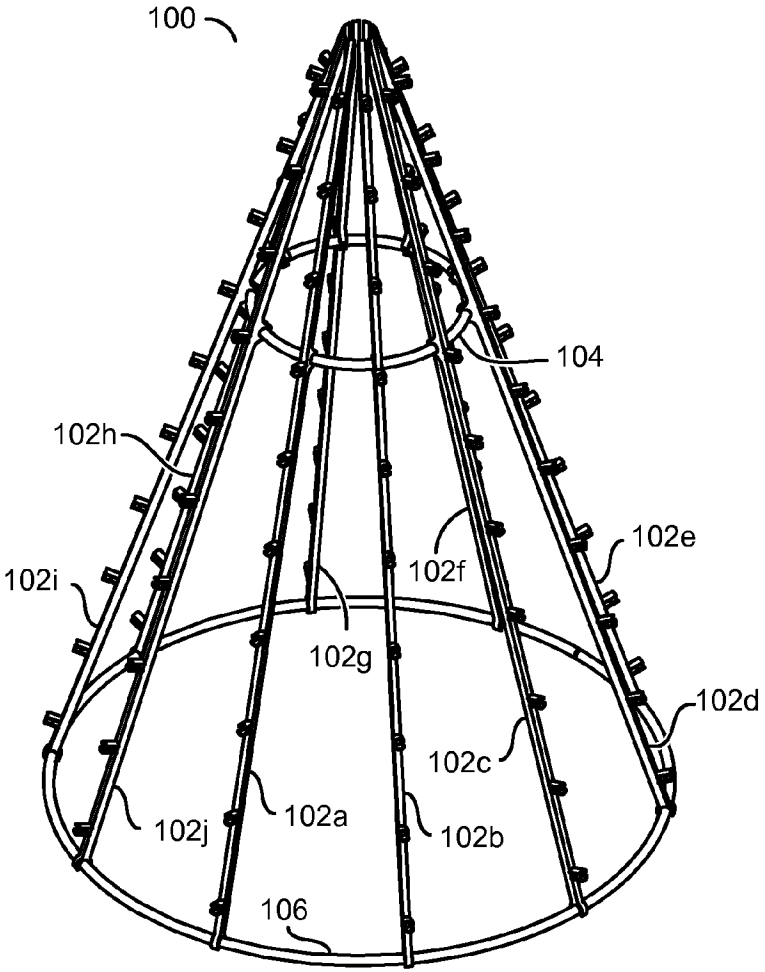
FIG. 15 shows an embodiment with ten legs.

Referring to FIG. 15, an overall diagram of an embodiment of the apparatus 100 with ten legs is shown. The apparatus 100 is shown in a generally perspective view. The ten legs 102*a*-102*j* are shown spaced evenly around the apparatus 100. Using the ten legs 102*a*-102*j* may allow for more support for the apparatus 100 and/or provide more options for decorating the apparatus 100.

Figure 16:
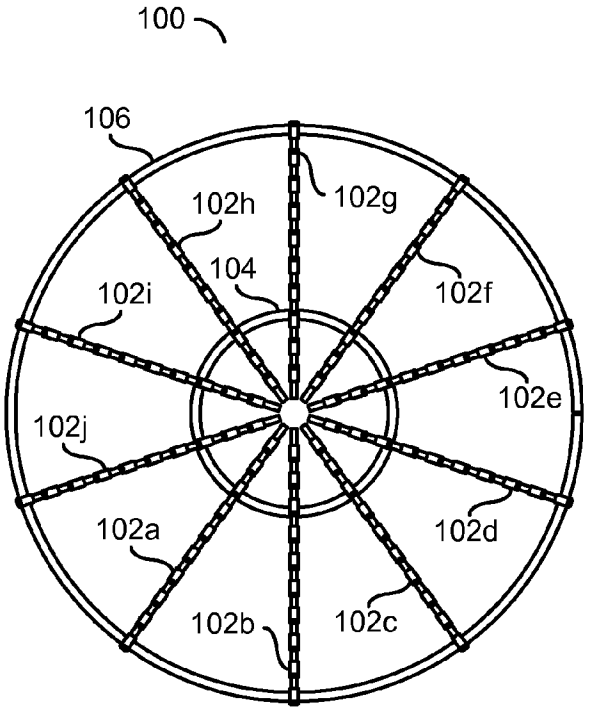
FIG. 16 shows a top view of the embodiment of FIG. 15.

Referring to FIG. 16, a top view of the embodiment of FIG. 15 is shown. The apparatus 100 is shown from a generally overhead view. The example of the apparatus 100 shown in FIG. 16 shows an implementation with the ten legs 102*a*-102*j*. The top view shows the ten legs 102*a*-102*j* evenly spaced about the support portion 104 and the support portion 106. Each of the legs 102*a*-102*j* are shown leaning inward from the support portion 106. Each of the legs 102*a*-102*j* generally approach (e.g., come close to) but do not touch the other legs 102*a*-102*j*. In some embodiments, the legs 102*a*-102*j* may touch at the top of the apparatus 100.

Figure 17:
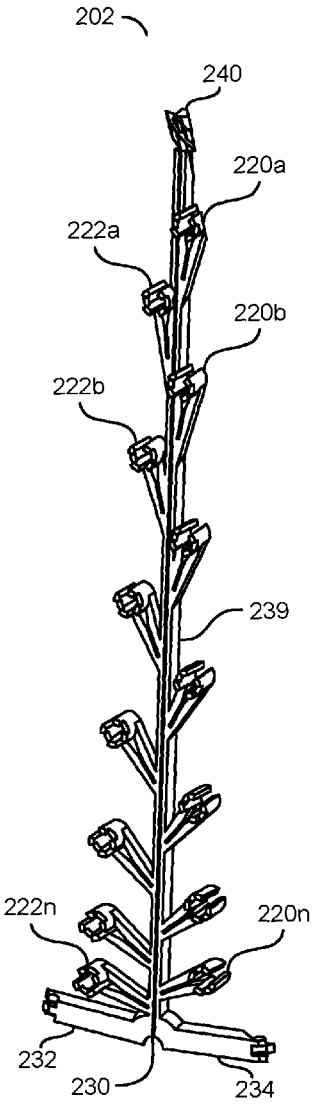
FIG. 17 shows an alternate implementation of a leg.

Referring to FIG. 17, a diagram of an alternate leg 202 is shown. A number of holder portions 220*a*-220*n* are shown on one side of the leg 202. A number of holder portions 222*a*-222*n* are shown on another side of the leg 202. A line (or axis) 230 shows a connection between a left side base 232 and a right side base 234. The line (or axis) 230 may allow the left side base 232 to flex with respect to the right side base 234 (e.g., the leg 202 may be flexible about the axis 230). The flex will be described in more detail in connection with FIGS. 20 and 21. The leg 202 may comprise a center support 239. The holder portions 220*a*-220*n* and/or the holder portions 222*a*-222*n* may be connected to the center support 239. The leg 202 is shown having a top portion 240. The top portion will be described in more detail in connection with FIGS. 18, 24 and 25. The center support 239 may extend from the base (e.g., the left side base 232 and the right side base 234) to the top portion 240 of the leg 202. The axis 230 may be along the center of the center support 239. The base 230 and the center support 239 may meet at a vertex point (e.g., a point on the axis 230). The holders 220*a*-220*n* are shown evenly spaced between the holders 222*a*-222*n* and on an opposite side of the leg 202. The holders 222*a*-222*n* are shown evenly spaced between the holders 220*a*-220*n* and on an opposite side of the leg 202. While the example shown illustrates an even spacing, the particular arrangement of the holders 220*a*-220*n* and/or the holders 222*a*-222*n* may be varied according to the design criteria of a particular implementation.

Figure 18:
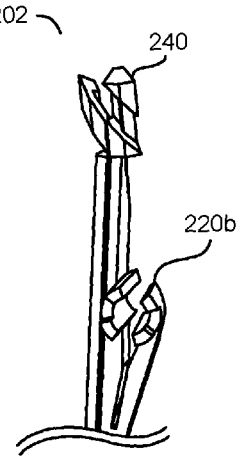
FIG. 18 shows details of a top section of the alternate leg of FIG. 17.

Referring to FIG. 18, details of a top section of the alternate leg of FIG. 17 is shown. The holder 220*b* is shown in more detail. The holder 220*b* may be configured to securely clip on to a light (not shown), garland (not shown), or other portions of a decorative arrangement. The top portion 240 is shown at the top end of the leg 202. The top portion 240 is shown as a part of a cylinder shape. For example, when the legs 202*a*-202*n* are arranged together, the top portions 240*a*-240*n* may form a complete cylinder shape. The type of shape of the top portion 240 may be varied according to the design criteria of a particular implementation. The top portion 240 is shown having a notch (or track). The notch may allow an ornament and/or a clasp device (e.g., a clip) to attach to the top portion 240.

Figure 19:
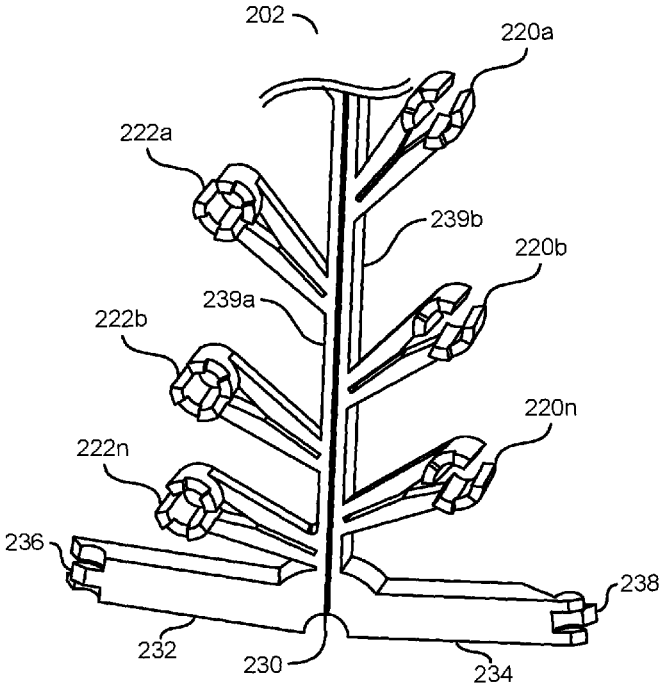
FIG. 19 shows details of a bottom portion of the leg of FIG. 17.

Referring to FIG. 19, details of a bottom portion of the leg of FIG. 17 is shown. The center support 239 is shown having a first side 239*a* and a second side 239*b*. The axis 230 may be located between (e.g., extend up the middle of) the first side of the center support 239*a* and the second side of the center support 239*b*. A number of holders (or connectors) 220*a*-220*n* and 222*a*-222*n* are shown. The holders 222*a*-222*n* may be molded to the first side of the center support 239*a*. For example, the holders 222*a*-222*n* may be evenly spaced along the first side of the center support 239*a*. The holders 220*a*-220*n* may be molded to the second side of the center support 239*b*. For example, the holders 222*a*-222*n* may connect to the first side of the center support 239*a* between where the holders 220*a*-220*n* connect to the second side of the center support 239*b*. The holders 220*a*-220*n* and/or the holders 222*a*-222*n* may be molded to extend upwards at an angle from the center support 239 in a direction towards the top portion 240 of the leg 202. The holders 220*a*-220*n* may be configured to hold one or more lights of a strand of lights (or other type of decoration). The left side base 232 and the right side base 234 (together providing a base for the leg 202) may have a length that is varied according to the design criteria of a particular implementation. For example, a base with a larger width may provide more stability for the leg 202.

The leg 202 (e.g., the left side base 232, the right side base 234, the center support 239, the holders 220*a*-220*n*, the holders 222*a*-222*n* and/or the top portion 240) may be molded from a unitary piece of plastic. One group of the holders (e.g., the holders 222*a*-222*n*), the left side of the center support 239*a* and/or the left side of the base 232 may be on one side (e.g., the left side) of the axis 230. Another group of the holders (e.g., the holders 220*a*-220*n*), the right side of the center support 239*b* and/or the right side of the base 234 may be on another side (e.g., the right side) of the axis 230. The left side base 232 is shown including a connector (or attachment portion) 236. The right side base 234 is shown including a connector (or attachment portion) 238. The connector 236 may be configured to connect (e.g., clip, secure, clasp, etc.) into the connector 238 of another one of the legs 202*a*-202*n*. Similarly, the connector 238 may be configured to connect (e.g., clip, secure, clasp, etc.) into the connector 236 of another one of the legs 202*a*-202*n*.

In the example shown, the connector 236 is shown having three prongs (e.g., two prongs on an inside surface of the leg 202 and one prong on the outside surface of the leg 202) and the connector 238 is shown having three prongs in an opposite configuration (e.g., two prongs on the outside surface of the leg 202 and one prong on the inside surface of the leg 202). The opposite configuration of the connectors 236 and 238 may allow the legs 202*a*-202*n* to form a secure lock. The shape and/or locking/securing mechanism of the connectors 236 and/or 238 may be varied according to the design criteria of a particular implementation.

Figure 20:
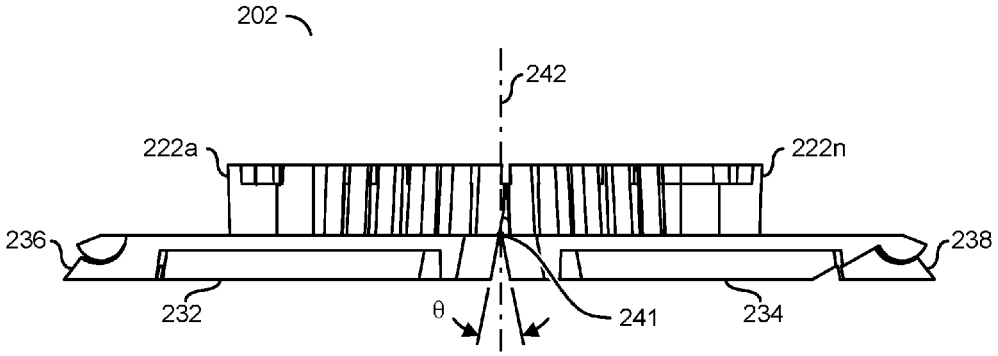
FIG. 20 shows a bottom view of the leg of FIG. 17 in an uncompressed state.

Referring to FIG. 20, a bottom view of the leg 202 of FIG. 17 is shown. The bottom view may show the left side base 232 and the right side base 234. The line 230 is shown in an unflexed state (e.g., the leg 202 may be uncompressed). An axis 242 is shown between the left side base 232 and the right side base 234. An angle θ is shown between the left side base 232 and the right side base 234. In the example shown in FIG. 20, the leg 202 is in a generally uncompressed state, where the angle θ is shown in an open position (e.g., the angle θ is a non-zero value). Generally, the leg 202 may be in an unflexed (or uncompressed) state when the apparatus 100 is not assembled. For example, the unflexed state may allow each of the legs 202*a*-202*n* to be stored (or stacked) flat (e.g., reducing an amount of storage space for the apparatus 100).

The vertex point 241 is shown. The vertex point 241 may be located where the left side base 232, the right side base 234 and the center support 239 meet (e.g., along the axis 230). The leg 202 may be flexed along the line 230. Flexing the base of the leg 202 along the axis 230 may enable the left side of the base 232 to flex with respect to the second side of the base at the vertex point 241. For example, the leg 202 may be flexed by pressing the left side base 232 and the right side base 234 in a generally downward direction, while the line 230 is either pressed in a generally upward direction (or is not moved). As the leg 202 is flexed, the angle θ may be reduced. A fully flexed (or compressed state) may reduce the angle θ to a value of zero. Flexing the leg 202 along the line 230 may increase an angle θ (to be described in more detail in FIG. 21). When the leg 202 is unflexed (e.g., in a fully uncompressed state), the angle θ may be at a maximum value. When the leg 202 is unflexed, the vertex point 241 may comprise a gap (e.g., a gap with the angle θ). The gap may be closed when the leg 202 is in a flexed state.

Figure 21:
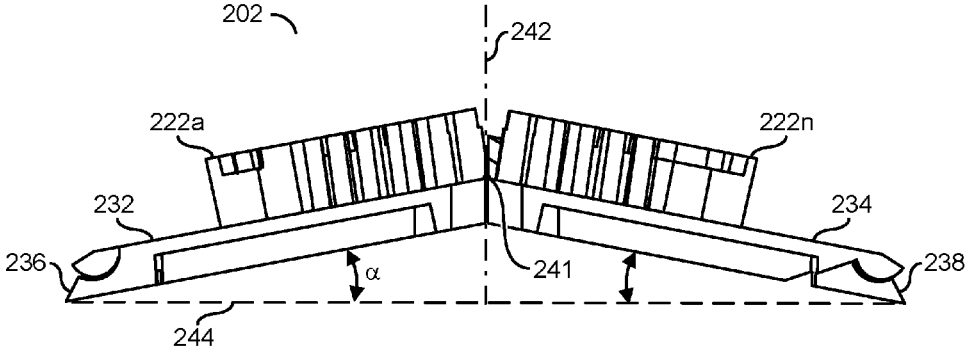
FIG. 21 shows another bottom view of the leg of FIG. 17 in a compressed state.

Referring to FIG. 21, another bottom view of the leg 202 of FIG. 17 is shown. The bottom view may show the vertex point 241, left side base 232 and the right side base 234. The line 230 is shown in a flexed state (e.g., the leg 202 may be compressed). The axis 242 is shown between the left side base 232 and the right side base 234. The angle α is shown with respect to a generally horizontal surface 244 (e.g., in the uncompressed state shown in FIG. 20, the left side base 232 and the right side base 234 may rest on the horizontal surface 244). The leg 202 is shown in a generally flexed (or compressed) state. In the compressed state, the angle θ is essentially zero. In the compressed state, the angle α may be a non-zero value. The gap of the vertex point 241 may close when the leg 202 is in the flexed (or compressed) state. The vertex point 241 may enable the left side of the base 232 to flex with respect to the right side of the base 234. The left side of the base 232 may be flexed with respect to the right side of the base 234 along the axis 230. In some embodiments, the angle α may be the same value in the compressed state as the angle θ in the uncompressed state. In some embodiments, the angle α in the compressed state may be different than the angle θ in the uncompressed state. The value of the angle θ and/or the angle α may be varied according to the design criteria of a particular implementation.

The pressure created when the legs 202*a*-202*n* are flexed may allow the apparatus to be held together without glue (or other type of adhesive). For example, the outward pressure created by the legs 202*a*-202*n* when flexed creates a locking effect (e.g., a secure lock). The locking effect may allow the apparatus 100 to be freestanding without external clips and/or external connectors. For example, the outward pressure created by the legs 202*a*-202*n* when flexed may improve a structural integrity of the frame 250. Generally, the leg 202 may be in a flexed (or compressed) state when the apparatus 100 is assembled.

Figure 22:
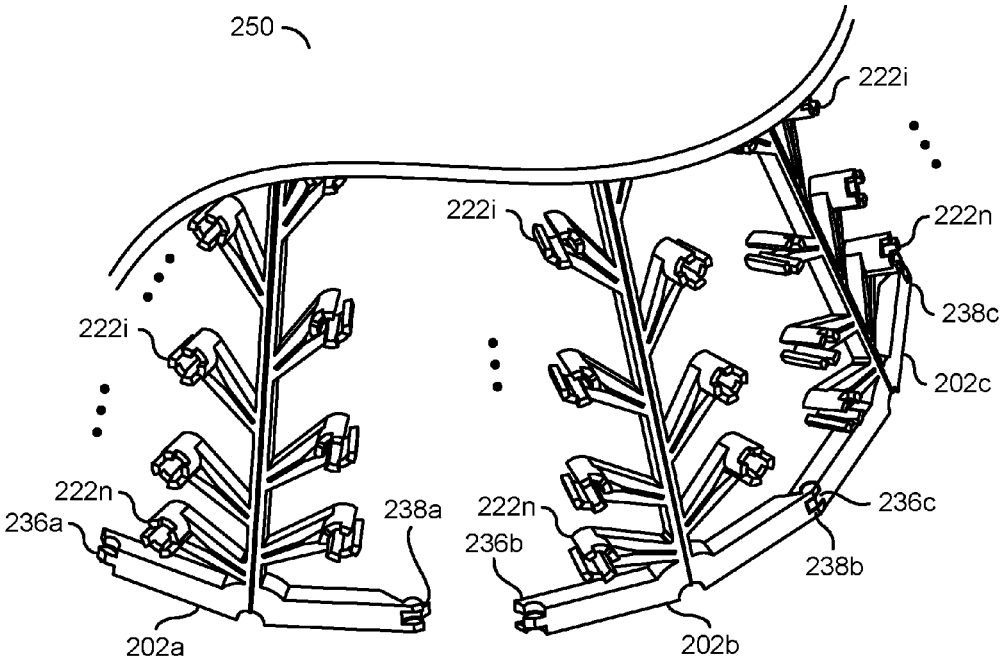
FIG. 22 shows a number of the legs of the embodiment of FIG. 17.

Referring to FIG. 22, a number of the legs 202*a*-202*c* of the embodiment of FIG. 17 are shown. The legs 202*a*-202*c* may be assembled to form a frame 250 (e.g., an assembled frame). The leg 202*a* is shown having a connector portion 236*a* (e.g., a left connector) and a connector portion 238*a* (e.g., a right connector). The frame 202*b* is shown having a connector portion 236*b* (e.g., a left connector). The connector portion 238*a* generally interlocks with the connector portion 236*b* (e.g., the right connector of the leg 202*a* connects to the left connector of the leg 202*b*). For example, the connector portion 236*b* is shown interlocked with the connector portion 236*c*. The legs 202*a*-202*c* are shown in a generally flexed state as the legs 202*a*-202*c* are interlocked.

Figure 23:
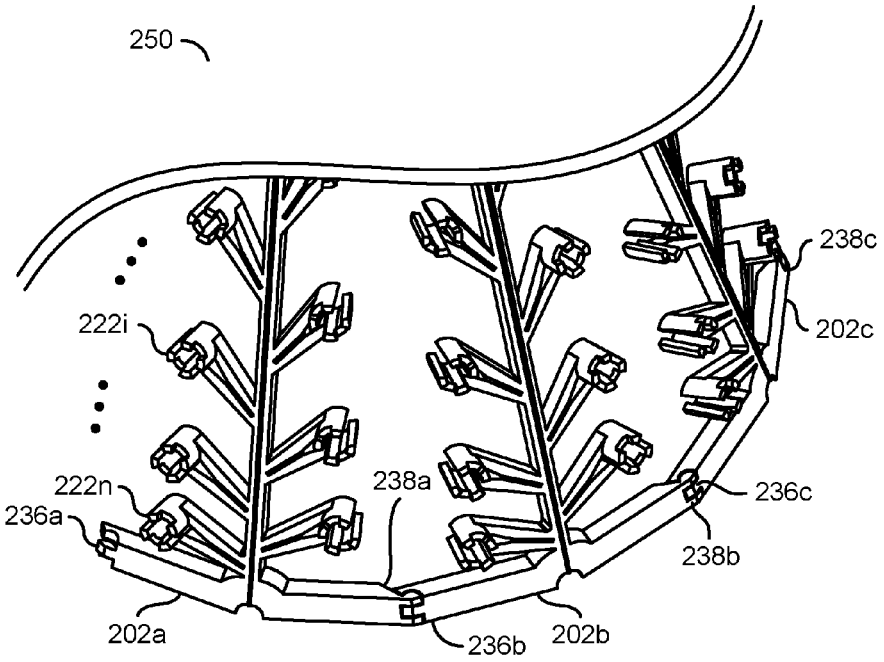
FIG. 23 shows a number of the legs of the embodiment of FIG. 17.

Referring to FIG. 23, a number of the legs 202*a*-202*c* of the embodiment of FIG. 17 are shown. The frame 250 is shown having each of the legs 202*a*-202*c* interconnected. For example, the right connector 238*a* of the leg 202*a* is interlocked with the left connector 236*b* of the leg 202*b* and the right connector 238*b* of the leg 202*b* is interlocked with the left connector 236*c* of the leg 202*c*. For example, the connectors 236*a*-236*n* and/or the connectors 238*a*-238*n* may form a secure lock when the legs 202*a*-202*n* are in a flexed state. When each of the legs 202*a*-202*n* are interconnected (or interlocked) the frame 250 may be in a fully assembled state (e.g., freestanding).

Figure 24:
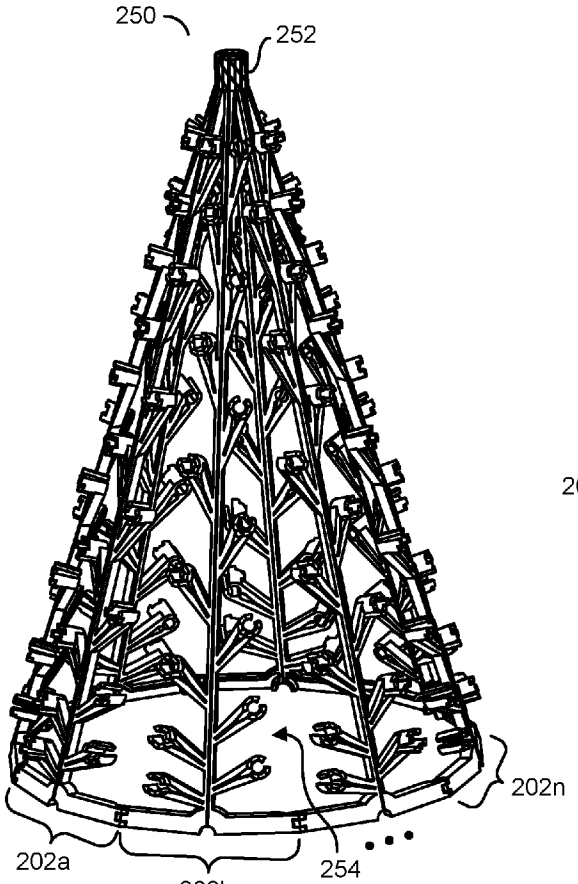
FIG. 24 shows an overall view of a plurality of the alternate legs connected.

Referring to FIG. 24, an overall view of a plurality of the alternate legs 202*a*-202*n* of the embodiment in FIG. 17 is shown. The frame 250 is shown in a generally completed state. For example, each of the legs 202*a*-202*n* may be in a flexed (or compressed) state. The flexed state of the legs 202*a*-202*n* may allow the assembled frame 250 to be freestanding. The legs 202*a*-202*n* are shown leaning inward to meet at a top of the frame 250. A center point 254 is shown. The center point 254 may be located in line with the top portions 240*a*-240*n*. The center point 254 may be a reference point for the center of the circular arrangement of the legs 202*a*-202*n*. For example, the bases of the legs 202*a*-202*n* may be arranged in the circular fashion about the top portions 240*a*-240*n* when viewed from directly above the frame 250. The vertex point 241 may enable the bases of the legs 202*a*-202*n* to be arranged in the circular fashion. An ornament 252 is shown on top of the assembled frame 250. For example, the ornament 252 may be configured to fit over the top portions 240*a*-240*n* of the legs 202*a*-202*n* (e.g., the ornament 252 may connect each of the legs 202*a*-202*n* together). In another example, the ornament 252 may slide and lock into the notches of the top portions 240*a*-240*n*.

In some embodiments, the ornament 252 may be used as a clasping device (or clip) to hold the legs 202*a*-202*n* together (e.g., to maintain a conical shape of the assembled frame 250). In some embodiments, the ornament 252 may rest on the legs 202*a*-202*n* for a decorative effect. In some embodiments, each of the top portions 240*a*-240*n* of the legs 202*a*-202*n* may extend towards the top portions 240*a*-240*n* of each of the legs 202*a*-202*n* (e.g., forming a point of the frame 250). For example, the top portions 240*a*-240*n* may approach, but not touch the other top portions 240*a*-240*n* (e.g., leaving a space at the top of the frame 250). The ornament 252 may be configured to fit (e.g., be secured) within the space at the top of the frame 250. The implementation of the ornament 252 and/or the top portions 202*a*-202*n* may be varied according to the design criteria of a particular implementation.

Figure 25:
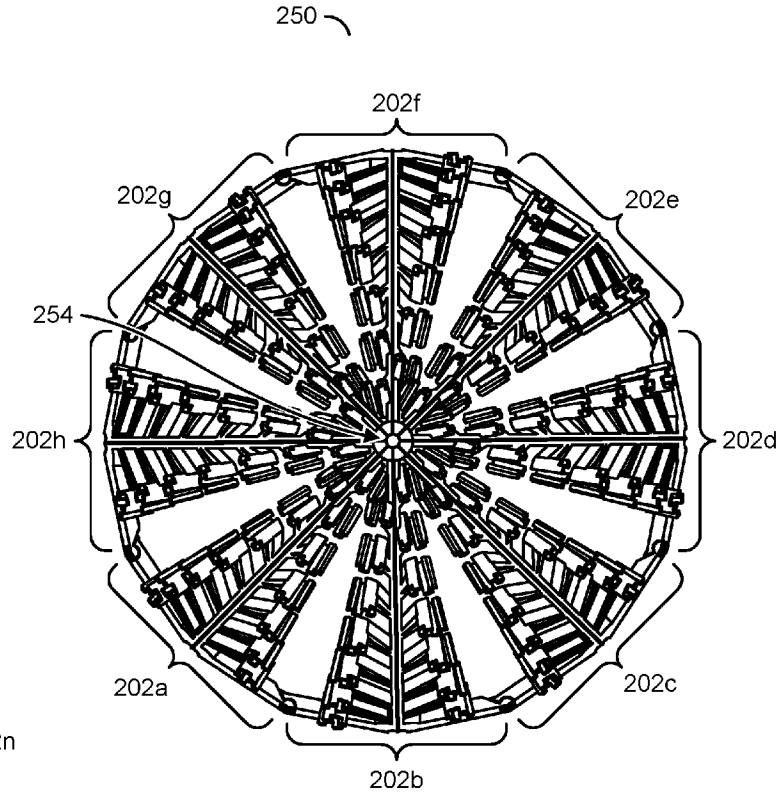
FIG. 25 shows a top view of a plurality of the alternate legs of FIG. 17 connected.

Referring to FIG. 25, a top view of a plurality of the legs 202*a*-202*h* of FIG. 17 is shown. A top view of the assembled frame 250 is shown. The top view of the assembled frame 250 shows the legs 202*a*-202*h* arranged in a circular fashion. The legs 202*a*-202*n* may lean towards the center point 254 (e.g., lean inwards) and the top portions 240*a*-240*n* may meet at (e.g., above) the center point 254 to arrange the frame 250 in the circular fashion. The example shown in FIG. 25 implements 8 of the legs 202*a*-202*h* to form the assembled frame 250. The number of legs 202*a*-202*n* of the assembled frame 250 may be varied according to the design criteria of a particular implementation. For example, using more of the legs 202*a*-202*n* may allow the assembled frame 250 to be larger (e.g., have a base with a larger radius).

Each of the portions of the apparatus 100 and/or the frame 250 (e.g., the legs 102*a*-102*n*, the inner support portion 104, the outer support portion 106, the legs 202*a*-202*n*, the holders 220*a*-220*n*, the holders 222*a*-222*n*) may be implemented using materials according to the design criteria of a particular implementation. For example, the material may be a plastic material. The plastic material may be through a molding process (e.g., injection molding).

While the invention has been particularly shown and described with reference to the preferred embodiments thereof, it will be understood by those skilled in the art that various changes in form and details may be made without departing from the scope of the invention.

The invention claimed is:

1. An apparatus comprising:

a plurality of legs each (i) molded from a unitary piece of plastic and (ii) having (a) a base, (b) a plurality of holders and (c) a center support, wherein (A) said center support extends from said base to a top portion of said leg along an axis, (B) said holders are connected to said center support, (C) said center support and said base meet at a vertex point, (D) said base comprises (i) a first connector on a first side of said vertex point and (ii) a second connector on a second side of said vertex point, (E) each of said plurality of bases is configured to (i) connect to said second connector of one of said plurality of legs using said first connector, (ii) connect to said first connector of another of said plurality of legs using said second connector, and (iii) be arranged in a circular fashion, (F) said vertex point enables each of said plurality of said bases to be arranged in said circular fashion about said top portion when viewed from directly above said apparatus, (G) said unitary piece of plastic is molded to allow each of the center support pieces to converge at said top portion and (H) said holders are configured to secure one or more lights of a strand of lights.

2. The apparatus according to claim 1, wherein said base is further configured to be flexed along said axis to enable said first side of said base to flex with respect to said second side of said base at said vertex point.

3. The apparatus according to claim 2, wherein outward pressure from flexing said plurality of legs about said axis increases structural integrity.

4. The apparatus according to claim 1, wherein said top portion of each of said plurality of legs is configured to be connected to each of said plurality of legs using a clasping device.

5. The apparatus according to claim 4, wherein said clasping device is an ornament placed on top of said apparatus.

6. The apparatus according to claim 1, wherein (i) said top portion of each of said plurality of legs is configured to extend towards each of said plurality of legs leaving a space at a top of said apparatus and (ii) an ornament is configured to be secured in said space at said top of said apparatus.

7. The apparatus according to claim 1, wherein a first group of said holders, a first side of said center support and said first side of said base are on a first side of said axis and a second group of said holders, a second side of said support and said second side of said base are on a second side of said axis.

8. The apparatus according to claim 7, wherein said first group of said holders are (i) evenly spaced along said first side of said center support and (ii) connect to said first side of said center support between where said second group of holders connect to said second side of said center support.

9. The apparatus according to claim 1, wherein said legs are configured to stack flat when (a) said apparatus is disassembled and (b) said legs are in an unflexed state along said axis.

10. The apparatus according to claim 1, wherein outward pressure from flexing said plurality of legs about said axis creates a secure lock.

11. The apparatus according to claim 1, wherein said vertex point enables said bases to be arranged in said circular fashion by enabling said first side of said base to flex with respect to said second side of said base.

12. The apparatus according to claim 1, wherein (i) said holders are molded into said center support of said legs and (ii) each of said holders is configured to secure one of said lights of said strand of lights.

13. The apparatus according to claim 1, wherein (i) said first connector and said second connector each comprise three prongs, (ii) said first connector has two of said three prongs on a first surface of said base and a last of said three prongs on a second surface of said base and (iii) said second connector has two of said three prongs on said second surface of said base and a last of said three prongs on said first surface of said base.

14. The apparatus according to claim 1, wherein said holders are molded to extend at an angle from said center support in a direction towards said top portion of said leg.

15. The apparatus according to claim 1, wherein (i) said vertex point comprises a gap when said leg is in an unflexed state and (ii) said gap closes when said leg is in a flexed state.

16. The apparatus according to claim 1, wherein (i) said legs are arranged in said circular fashion by leaning each leg towards a center point and (ii) said top portion of each of said legs meet at said center point.

17. The apparatus according to claim 16, wherein said closed gap enables said base to flex towards an outside of said circular arrangement.

18. The apparatus according to claim 1, wherein said center support pieces are configured to converge at said top portion without bending.

19. The apparatus according to claim 1, wherein said center support pieces converge at said top portions prior to fastening a clasping device to said legs.

20. The apparatus according to claim 1, wherein said holders are configured to hold an ornamental light at a 90 degree orientation with respect to an orientation of said center supports.

* * * * *